US006217372B1

(12) United States Patent
Reed

(10) Patent No.: US 6,217,372 B1
(45) Date of Patent: Apr. 17, 2001

(54) CABLE STRUCTURE WITH IMPROVED GROUNDING TERMINATION IN THE CONNECTOR

(75) Inventor: Bruce Reed, Richmond, VT (US)

(73) Assignee: Tensolite Company, St. Augustine, FL (US)

( * ) Notice: Subject to any disclaimer, the term of this patent is extended or adjusted under 35 U.S.C. 154(b) by 0 days.

(21) Appl. No.: 09/416,510

(22) Filed: Oct. 8, 1999

(51) Int. Cl.[7] ..... H01R 12/24

(52) U.S. Cl. ..... 439/497; 439/108

(58) Field of Search ..... 439/95, 607, 497, 439/108, 610, 143

(56) References Cited

U.S. PATENT DOCUMENTS

| | | | |
|---|---|---|---|
| 3,149,893 | 9/1964 | Dupre . | |
| 3,587,028 | 6/1971 | Uberbacher | 339/14 |
| 3,587,029 | 6/1971 | Knowles . | |
| 3,689,865 | 9/1972 | Pierini et al. | 339/17 |
| 4,005,921 | 2/1977 | Hadden et al. | 339/14 R |
| 4,094,564 | 6/1978 | Cacolici | 339/14 |
| 4,123,842 | 11/1978 | Cooper | 29/592 R |
| 4,130,934 | 12/1978 | Asick et al. | 29/628 |
| 4,153,326 | 5/1979 | Frantz et al. | 339/99 R |
| 4,274,699 | 6/1981 | Keim | 339/176 |
| 4,275,945 | 6/1981 | Krantz et al. | 339/147 |
| 4,337,989 | 7/1982 | Asick et al. | 39/143 R |
| 4,352,531 | 10/1982 | Gutter | 339/14 R |
| 4,362,350 | 12/1982 | von Harz | 339/143 |
| 4,406,512 | 9/1983 | Schell | 339/177 R |
| 4,451,099 | 5/1984 | Bricker, Jr. et al. | 339/14 |
| 4,470,657 | 9/1984 | Deacon | 339/143 R |
| 4,508,415 | 4/1985 | Bunnell | 339/143 R |
| 4,601,527 | 7/1986 | Lemke | 339/14 R |
| 4,602,830 | 7/1986 | Lockard | 339/14 R |
| 4,602,831 | 7/1986 | Lockard | 339/14 R |
| 4,615,578 | 10/1986 | Stadler et al. | 339/143 R |
| 4,619,487 | 10/1986 | Brush, Jr. | 339/14 R |

(List continued on next page.)

FOREIGN PATENT DOCUMENTS

| | | |
|---|---|---|
| 42 94 443 T1 | 1/1994 | (DE) . |
| 49-6543 | 2/1974 | (JP) . |
| 50-18198 | 6/1975 | (JP) . |
| 52-33091 | 3/1977 | (JP) . |
| 54-15294 | 1/1979 | (JP) . |
| 54-110491 | 8/1979 | (JP) . |
| 58-379 | 1/1983 | (JP) . |
| 60-93780 | 5/1985 | (JP) . |
| 60-115475 | 8/1985 | (JP) . |
| 61-172480 | 10/1986 | (JP) . |
| 63-158766 | 7/1988 | (JP) . |
| 2-155178 | 6/1990 | (JP) . |
| 6-509676 | 10/1994 | (JP) . |
| WO 93/12564 | 6/1993 | (WO) . |

*Primary Examiner*—Gary F. Paumen
*Assistant Examiner*—Phuongchi Nguyen
(74) *Attorney, Agent, or Firm*—Wood, Herron & Evans L.L.P.

(57) ABSTRACT

A cable structure for signal transmission comprises a connector housing and a plurality of housing contacts positioned within a defined contact plane in the connector housing. The housing contacts are configured for engaging external contacts of a device when the cable structure is coupled to a device. At least one signal conductor terminates in the connector housing, and is electrically coupled to one of the housing contacts generally in said contact plane. At least one ground conductor terminates in the connector housing, in a second plane spaced from the contact plane. A shorting bar has a first portion positioned generally in said contact plane and electrically coupled to a housing contact. A second portion of the shorting bar is positioned generally in said second plane and is electrically coupled to the ground conductor. The shorting bar maintains the signal conductor and ground conductor termination within separate spaced planes to improve the signal integrity of the cable structure while keeping the housing contacts in a common plane.

18 Claims, 3 Drawing Sheets

U.S. PATENT DOCUMENTS

| | | | |
|---|---|---|---|
| 4,623,211 | 11/1986 | Dambach et al. | 339/143 R |
| 4,653,825 | 3/1987 | Olsson | 339/48 |
| 4,653,836 | 3/1987 | Peele | 339/143 R |
| 4,653,837 | 3/1987 | Phillipson et al. | 339/143 R |
| 4,655,515 | 4/1987 | Hamsher, Jr. et al. | 339/14 R |
| 4,655,518 | 4/1987 | Johnson et al. | 339/17 |
| 4,659,163 | 4/1987 | Althouse et al. | 339/143 |
| 4,671,599 | 6/1987 | Olsson | 439/188 |
| 4,673,236 | 6/1987 | Musolff et al. | 439/609 |
| 4,678,121 | 7/1987 | Douty et al. | 439/610 |
| 4,679,879 | 7/1987 | Triner et al. | 439/425 |
| 4,681,382 | 7/1987 | Lockard | 439/92 |
| 4,707,040 | 11/1987 | Hansel, III | 439/510 |
| 4,710,133 | 12/1987 | Lindeman | 339/14 |
| 4,737,117 | 4/1988 | Lockard | 439/92 |
| 4,767,345 | 8/1988 | Gutter et al. | 439/92 |
| 4,773,878 | 9/1988 | Hansell, III | 439/497 |
| 4,781,620 | 11/1988 | Tengler et al. | 439/497 |
| 4,790,775 | 12/1988 | David | 439/579 |
| 4,808,115 | 2/1989 | Norton et al. | 439/79 |
| 4,820,175 | 4/1989 | Hasegawa et al. | 439/98 |
| 4,824,383 | 4/1989 | Lemke | 439/108 |
| 4,840,573 | 6/1989 | Seidel et al. | 439/92 |
| 4,842,555 | 6/1989 | Cosmos et al. | 439/609 |
| 4,846,727 | 7/1989 | Glover et al. | 439/608 |
| 4,925,400 | 5/1990 | Blair et al. | 439/374 |
| 4,946,397 | 8/1990 | Grasser | 439/532 |
| 4,975,069 | 12/1990 | Fedder et al. | 439/101 |
| 4,981,447 | 1/1991 | Ichitsubo | 439/607 |
| 4,985,000 | 1/1991 | Tengler et al. | 439/497 |
| 4,990,094 | 2/1991 | Chandler et al. | 439/108 |
| 5,009,614 | 4/1991 | Fogg et al. | 439/497 |
| 5,032,089 | 7/1991 | Hansell, III | 439/609 |
| 5,035,631 | 7/1991 | Piorunneck et al. | 439/108 |
| 5,052,948 | 10/1991 | Hyzin | 439/607 |
| 5,057,028 | 10/1991 | Lemke et al. | 439/101 |
| 5,057,038 | 10/1991 | Bowen et al. | 439/497 |
| 5,059,140 | 10/1991 | Philippson et al. | 439/607 |
| 5,066,236 | 11/1991 | Broeksteeg | 439/79 |
| 5,085,596 | 2/1992 | Bowen et al. | 439/497 |
| 5,102,344 | 4/1992 | Tadokoro et al. | 439/98 |
| 5,104,341 | 4/1992 | Gilissen et al. | 439/608 |
| 5,115,562 | 5/1992 | Bowen et al. | 29/867 |
| 5,116,230 | 5/1992 | Dechelette et al. | 439/101 |
| 5,141,445 | 8/1992 | Little | 439/108 |
| 5,160,273 | 11/1992 | Carney | 439/108 |
| 5,176,538 * | 1/1993 | Hansell, III et al. | 439/607 |
| 5,190,472 | 3/1993 | Voltz et al. | 439/579 |
| 5,194,020 | 3/1993 | Voltz | 439/579 |

* cited by examiner

CABLE STRUCTURE WITH IMPROVED GROUNDING TERMINATION IN THE CONNECTOR

FIELD OF THE INVENTION

This present invention relates generally to signal transmission cable structures for electronic devices and particularly to improving the performance and construction of such a cable structure by improving the ground termination at the connector of the cable structure.

BACKGROUND OF THE INVENTION

The use of electronic devices of all kinds has increased dramatically throughout society, which has led to a significant increase in the demand for improved components utilized with such devices. One facet in the utilization of such electronic devices involves the data communications between such devices within a networked system. For example, many electronic devices may now be coupled and synchronized with other electronic devices, such as a computer, for transmitting data and other information back and forth between the various devices.

For accurate data and information transmission in such a system, the components of the system devices, and particularly the interface components of the system which connect between the various electronic devices, must be optimized for greater speed and performance. One particularly important interface component is the transmission cable which extends between the electronic devices that are communicating. Various cable designs have been utilized for such data and information transmission. Generally, suitable cable structures utilize a plurality of electrical conductors and a connector structure at one or both ends which interfaces with the connector structure of the electronic device. For example, connectors of a cable might plug into appropriate socket structures in the electronic devices. The electrical conductors include signal conductors; that is, transmission lines which carry the actual data or information signals, and ground conductors which provide an electrical reference for the transmitted data and information.

While the conductor or cable portions of existing cable structures have been suitable in maintaining the integrity of the signals transmitted thereon, significant attention has been paid to the termination components of the cable structure, generally referred to as the connector. The connector of the cable structure provides a transition between the individual electrical conductors of the cable portion, and hence the transmitted signals, and the internal circuitry of the electronic device to which the cable structure is connected. Generally, such connectors utilize a plurality of contacts, often in the form of conductive strips, pins and/or tabs. The electrical conductors, i.e., the signal and ground conductors, terminate at the contacts of the connector, and are electrically coupled to the contacts. The electronic device then includes its own set of contacts, such as pins or tabs, within a socket, for example, for interfacing with the contacts of the connector and thereby providing electrical coupling between the electronic devices at either end of the cable structure. Oftentimes, the interface between a cable structure connector and electronic device involves the cable structure connector engaging a socket in the electronic device, which includes pins or other contacts that engage the connector in a male-female relationship. However, Various other different connector structures have been utilized as evidenced by numerous patents in the field directed to such connector designs.

In some cable structures, each signal conductor is associated with a ground conductor. Therefore, the connectors of such cable structures provide individual contacts for each of the signal conductors and each of the ground conductors. Therefore, there are multiple ground contacts in the connectors. However, depending upon the number of conductors within a cable structure, such an arrangement may require a large or bulky connector structure. It is a goal within the field of transmission cable structures to minimize the size of the connector, while still maintaining a sufficient signal conductor density and maintaining the integrity of the transmitted signals.

To that end, attempts have been made to make cable structures wherein the connectors utilize multiple ground conductors which are electrically coupled to a single ground reference. Since the ground conductors are not carrying different signals, they can all be coupled to a suitable single ground reference without affecting the operation of the cable structure. For example, some attempts have been made to couple all the ground connectors to a grounding shield. Another cable structure utilizes a grounding device including a carrier strip with a plurality of conductive strips extending therefrom. The conductive strips are coupled to the carrier strip by score lines and thus may be readily separated from the carrier strip. Depending upon the connector design, one or more conductive strips will be utilized with the carrier strip to make the ground connection within the connector, whereas other conductive strips are broken off from the carrier strip at their score lines to form signal contacts. The carrier strip is then connected to the ground conductors and one or more of the conductive strips still connected to the carrier strip form the ground contact of the cable structure. A single ground reference is thus utilized to service various of the ground conductors. Other of the conductive strips form the signal contacts.

While the goal of utilizing a single ground reference for multiple ground conductors within a cable structure is achieved, prior designs have had significant drawbacks. First, such designs are generally less robust due to the score lines between the conductive-ground contacts and carrier strip. Movement of the cable and manipulation of the connector may cause physical separation of the ground strips at the score line, thus creating an open circuit condition at the ground contacts. Furthermore, during the manufacturing of a cable structure utilizing such a connector design, an additional and costly step is involved to detach any non-ground contacts from the carrier strip and to insure that the grounded carrier strip is only coupled to the ground contacts and not any of the signal contacts.

Another drawback to such a design is the tenuous signal integrity that exists in such a connector. The contact/carrier strip design requires very close proximity of the grounded carrier strip and the signal contact strips which have been detached from the carrier strip. Thus, movement of the contact strips or the carrier strip may result in shorting of the signal conductor to ground. Accordingly, prior art structures utilizing such a connector-ground configuration have a less robust construction wherein signal integrity is jeopardized and additional manufacturing steps are required, thus increasing the cost of manufacturing the cable structure.

Still another drawback to existing connector designs involves the conductor cross-over that is often utilized in such designs. Specifically, the signal conductors may cross over the ground conductors for construction of the connector. In further constructing the connector, it may be necessary to apply pressure and or high temperatures to the end of the cable, such as when the connector body is being molded around the ends of the conductors. When the conductors are crossed over each other, they may be pressed together under the high temperature and pressure and this may cause a short circuit condition.

Therefore, it is desirable to have a cable structure for communication between electronic devices which has improved signal integrity through the connector.

Furthermore, it is desirable to reduce the cost of manufacturing such cable structures and connectors.

Additionally, it is desirable to reduce the possibility of shorting between a signal conductor and a ground conductor within the connector to thereby further improve the integrity of the signal transmitted through the cable structure.

It is further desirable to have a connector design which is sufficiently compact, but which maintains a useful density of signal conductors.

These objectives and other objectives will become more readily apparent from the summary of invention and detailed description of embodiments of the invention set forth herein below.

SUMMARY OF THE INVENTION

The cable structure of the invention maintains the signal conductors and ground conductors within separate, spaced planes to improve the signal integrity of the cable structure and reduce the possibility of the signal conductors shorting to ground. The ground contact is maintained in a common plane with the other signal contacts to thus keep the size of the connector structure suitably compact.

In one embodiment of the invention, a shorting bar has a first portion which is positioned generally within a contact plane defined by and containing other signal contacts. A second portion of the shorting bar is positioned in a second or ground plane which is vertically spaced from the contact plane, and is electrically coupled to various ground conductors. In the embodiment of the invention illustrated, the shorting bar is coupled to the ground conductors in a ground plane rearward of and vertically below the contact plane containing the signal conductors. Thus, signal integrity and the durability of the cable is improved, and the need for conductor cross-over is eliminated.

In one embodiment of the invention, a connector housing has a plurality of housing contacts positioned therein which define a contact plane. The contacts are configured for interfacing with pins of a socket in the electronic device to which the cable structure is connected. One or more signal conductors terminate in the connector housing and the terminal ends of the signal conductors are electrically coupled to the housing contact, generally within the contact plane. In one embodiment of the invention, the contacts have flat strip portions and the terminal ends of the signal conductors are positioned on top of the strip portions and welded thereto.

One or more ground conductors are positioned alongside the signal conductors and terminate in the connector housing. The electrically conductive shorting bar has a first portion which is positioned proximate and generally within the contact plane and which is electrically coupled to one of the housing contacts to thereby form and define the ground contact. A second portion of the shorting bar, including multiple legs, is positioned generally in the second, or ground, plane which is vertically spaced from the first portion. The second portion is welded to the terminal ends of the ground conductors. Therefore, the terminal ends of the ground conductors are maintained in a plane vertically spaced from the contact plane in which the signal conductors terminate.

In a preferred embodiment, the shorting bar couples to the terminal ends of the ground conductors, not only in a plane below the contact plane containing the terminal ends of the signal conductors, but also longitudinally rearwardly of the signal conductor terminal ends. The shorting bar thus maintains the signal conductor and ground conductor terminations within separate, spaced planes to improve the signal integrity of the cable structure and reduce the possibility of the signal conductor being grounded.

However, the shorting bar is also coupled to housing contacts within the contact plane such that all the housing contacts are maintained within a common plane to keep the size of the connector suitably compact. Furthermore, the conductors are maintained in a side-by-side fashion at the ends thereof without any cross-over of the conductors. This further reduces the possibility of an undesired short circuit at the connector.

In one embodiment of the invention, the shorting bar is in the form of a unitary metal strip which includes a transition portion spanning between the first and second portions. The first, second, and transition portions are all integrally formed of an electrically-conductive material such as metal, and the second section comprises a plurality of legs which extend laterally with respect to the longitudinal axis of the first portion of the shorting bar to engage the ground conductors where they terminate, rather than having the ground conductors bend significantly toward the center ground contact and create a cross-over situation.

The cable structure further comprises a shield including a tab depending downwardly therefrom and electrically coupled to the ground contact and thereby electrically coupled to the grounding bar and ground conductors.

The integral construction of the shorting bar ensures that it is generally free of score lines between the first and second portions and thus provides a more robust connector. Therefore, there is little probability that a break would occur along the shorting bar thus disconnecting the ground conductors from the ground contact of the connector. Once the shorting bar is installed and welded to the ground contact and the ground conductors, there is no additional step required for further manipulating the shorting bar or other connector components to eliminate short circuits. Therefore, the cost of manufacturing the cable structure is reduced. Furthermore, since the signal conductors and ground conductors are maintained in separate, vertically-spaced planes with no cross-over, there is very little possibility of inadvertent connection between a signal conductor and a ground conductor or ground contact, to thereby improve the integrity of the signal transmitted through the cable structure. The connector is compact, and maintains a suitable density of signal conductors accessible through the connector, with a single ground contact serving as the ground reference for all the signal conductors.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1:
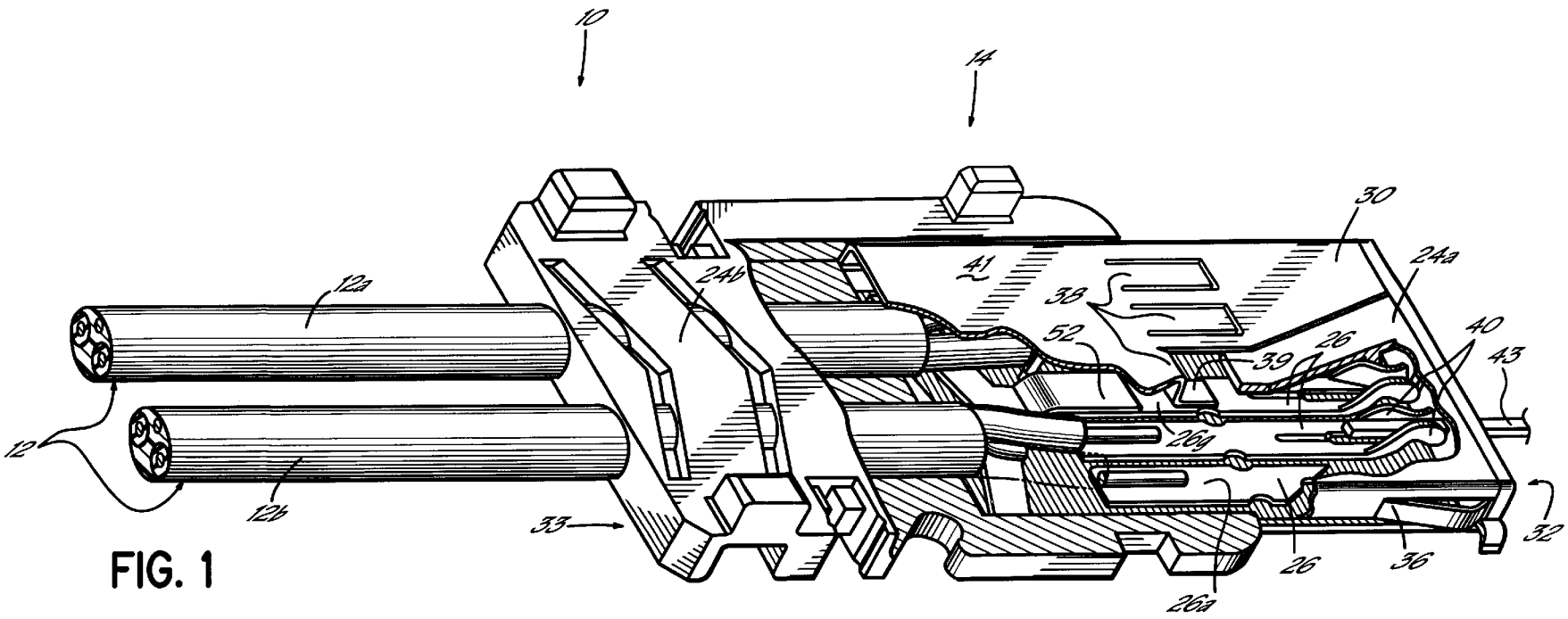
FIG. 1 is a top perspective view (partially cut away), of an embodiment of the invention illustrating features thereof.

FIG. 1 is a perspective view, partially cut away, illustrating one embodiment of the present invention. Cable structure 10 comprises one or more cable portions or transmission lines 12 terminating in a connector 14. In the embodiment illustrated in FIG. 1, two transmission lines 12*a*, 12*b* terminate in the connector 14. A single transmission line could be utilized in the invention, or a greater number of transmission lines than those shown in FIG. 1 may also be utilized in accordance with the principles of the present invention.

Figure 2:
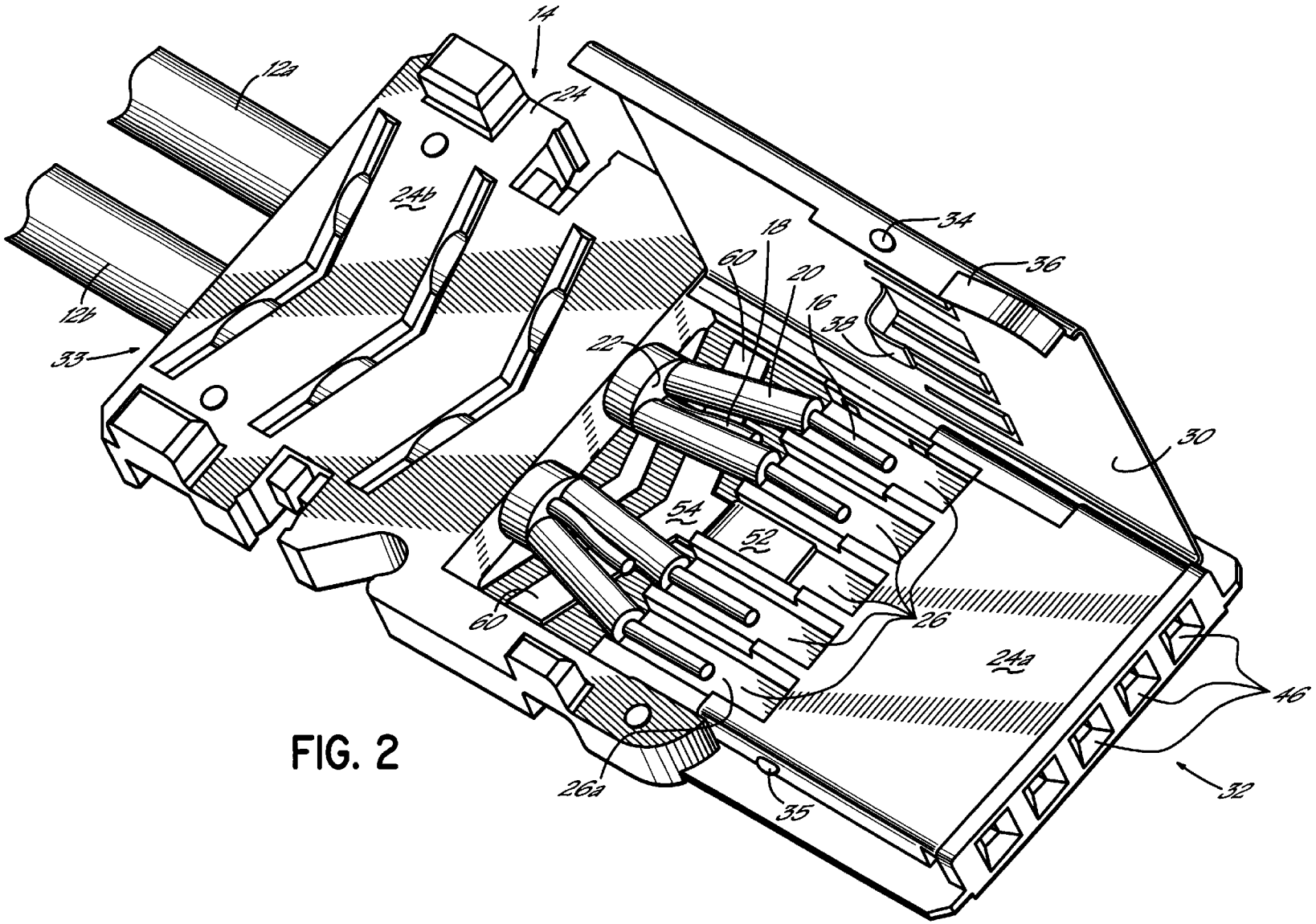
FIG. 2 is another perspective view of the invention showing the shield partially moved away from the connector to expose the conductor terminal ends and the shorting bar connection.

Referring to FIG. 2, each of the transmission lines 12 includes multiple signal conductors 16 and a ground conductor 18. The ground conductor 18 is often referred to as a drain wire. Suitable conductors for the invention are formed of wires such as multi-stranded copper wires, although solid copper wires might also be utilized. Each of the signal conductors 16 are separately insulated by insulation 20, which may be extruded onto the conductors. The signal conductor 16 and ground conductor 18 are then bundled together and surrounded by other insulative material 22, which may be extruded onto the bundled conductors. It will be understood by a person of ordinary skill in the art that the type of transmission line used in the invention could take any suitable form and is not limited to that shown in the Figures. In the embodiments illustrated in the Figures of this application, two signal conductors 16 are serviced by a single ground conductor 18, although more or less signal conductors and ground conductors might be utilized within each transmission line 12.

The connector 14 comprises a connector housing 24 formed of a suitable plastic material which is molded around the other components of the connector. One suitable material for molding the connector housing 24 is a liquid crystal polymer such as the VECTRA polymer available from Celanese. The entire housing 24 may be molded around the other components of the connector 14 in a single step, or might be molded in various steps. For example, a section of the housing which contains the terminal ends of the conductors 16, 18, and the conductor contacts, as discussed below, might first be molded to hold the contacts and other elements in position. Then a rear portion of the housing which surrounds portions of the transmission lines 12 might be molded over the first-molded portion. Housing 24 includes a forward portion 24*a* which encloses a plurality of contacts (see FIG. 1). A rear portion 24*b* of the housing surrounds portions of the transmission lines 12 to ensure that the transmission lines are secure to the connector 24 and that various conductors of the transmission lines are properly positioned for engaging the respective contacts 26. The housing is configured such that openings 46, formed therein to receive male pins 43, are aligned with the contacts 26. The connector housing 24 may take numerous forms and the housing shape shown in the Figures is only one embodiment of a suitable housing. As will be understood by a person of ordinary skill in the art, the housing shape will depend upon the ultimate end application of the cable structure and the device to which it must connect.

The connector structure 14 further comprises a metal shield 30 which overlies portions of the connector housing 24, the individual conductors 16 and 18, and the contacts 26. The shield 30 is coupled to a ground contact and is therefore grounded. In one embodiment of the invention, the shield is formed of a phosphor bronze metal with a plating comprising a layer of nickel and a layer of gold thereon. The thickness of the nickel layer decreases proceeding from the front 32 to a rear 33 of the connector. Referring to FIG. 2, the shield includes a detent 34 which receives an upstruck knob 35 of the connector housing for the purposes of aligning and securing the shield to the housing 24. Side spring tangs or tabs 36 of the shield insure a friction fit within a socket or other structure (not shown) when the connector is coupled to an electronic device.

Within the embodiment of the invention illustrated in the Figures, the center contact 26*g* is designated as a ground or drain contact. Shield 30 includes a tongue 38 which is configured to engage the ground contact 26*g*. Tongue 38 forms a pad 39 which extends downwardly below the upper surface 41 of the shield to engage contact 26*g*. The contact 26*g* and other contacts 26 are positioned in a plane below the plane defined by the shield body 41. In the embodiment of the invention illustrated, the ground contact 26*g* is the center contact. However, any of the contacts 26 might be designated as ground contacts. To that end, shield 30 includes multiple tongues 38, any of which may be formed to create a pad 39, which is then electrically coupled to a contact 26. Preferably, pad 39 is welded to a contact, such as contact 26*g*.

Referring to FIG. 1, the contacts extend along a significant portion of the length of the conductor housing and extend from the housing openings 46 at the front of the connector to overlap or underlap with the terminal ends of the signal conductors 16. The contacts 26 include planar strip portions 26*a* which define a contact plane and ultimately define the plane of the connector (see FIG. 1). They are generally flat along their length and are flat at their overlap with the signal conductors 16. At the ends of the contacts proximate the front end 32 of connector housing 24, the contacts form flexible opposing finger portions or fingers 40 which are utilized to grip another contact, such as a pin 43, from the socket or interface structure of an electronic device to which cable structure 10 is connected. One suitable contact structure 26 is formed of a phosphor bronze metal with a nickel and gold plate layer similar to the shield.

With respect to the contacts 26 and the contact plane defined thereby, it should be understood that the term "plane" as used herein is meant to refer to a particular orientation and positioning of one element of the invention with respect to another element of the invention. For an element to be "within a plane" it does not require that element to be absolutely coextensive with another element also "in the plane." For example, in describing the present invention, the terminal ends of the signal conductors 16, as shown in FIG. 2, are coupled to the contacts 26 generally in or within the contact plane, although the terminal ends are shown overlapping or overlaying the contact strip portions 26*a*. Furthermore, as discussed below, a planar first portion 52 of a shorting bar is shown coupled to contact 26g in or proximate the contact plane defined by the contacts 26.

Referring now to FIG. 2, the front end 32 of connector housing 24 includes a plurality of pin openings 46 which are formed to receive pins 43 such as from a socket to which the cable structure 10 is connected. Therefore, connector 14 forms a female portion of a male-female interface between the cable structure 10 and an electronic device. Other embodiments of the invention might utilize contacts which themselves form pins to be received by a female portion within the socket of an electronic device. As will be understood, the contacts 26 of the invention might take numerous forms in addition to those specifically set forth in the Figures.

Figure 4:
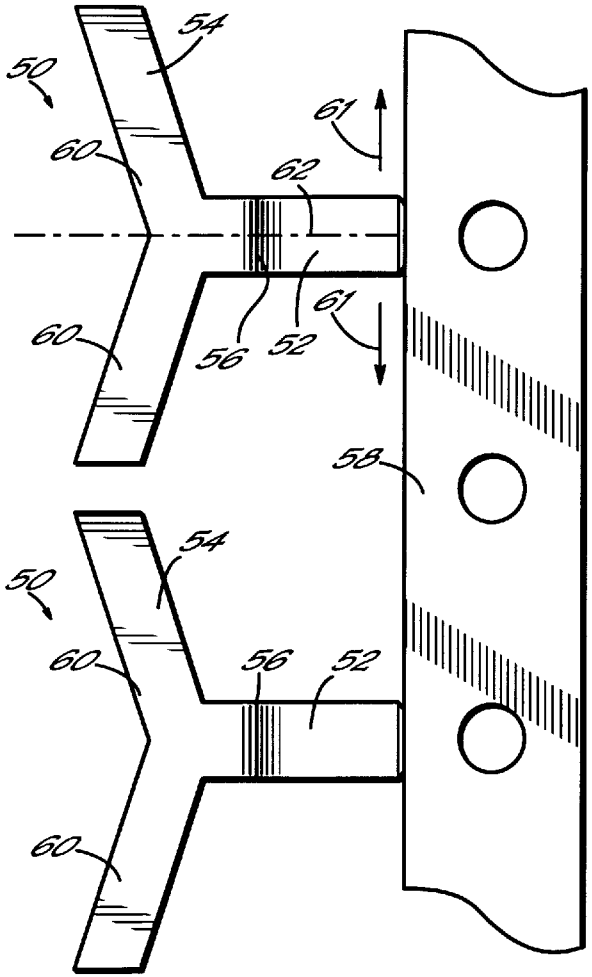
FIG. 4 is the top view of one embodiment of a shorting bar of the invention shown attached to a carrier strip for manufacturing purposes.
Figure 3:
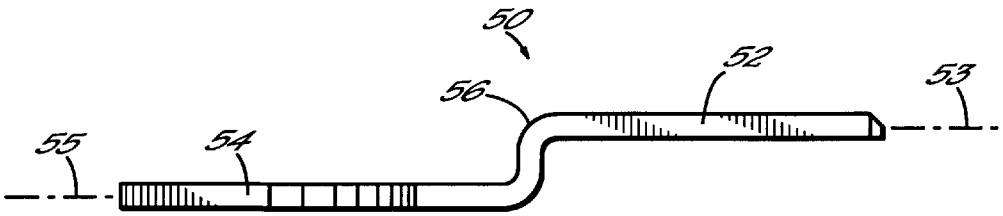
FIG. 3 is a side view of one embodiment of a shorting bar as utilized within the present invention.

Turning now to FIGS. 3 and 4, an electrically conductive shorting bar is utilized within the cable 10 of the invention, as shown. The shorting bar 50 is formed of a suitably conductive material such as a phosphor bronze metal and is tin coated in one embodiment of the invention. The shorting bar provides a ground connection between the ground contact, such as contact 26*g,* and ground conductors 18 of the transmission lines 12. In accordance with one aspect of the present invention, the shorting bar 50 has a first portion 52 and a second portion 54 coupled together with an angled or sloped transition portion 56. The second portion is positioned generally in a plane vertically spaced from the first portion. Preferably, the shorting bar 50 is formed as an integral piece and may be appropriately stamped, with a plurality of such parts attached to a carrier strip 58, as illustrated in FIG. 4. The carrier strip has openings 59 for indexing the strip during a manufacturing process. In the present invention, the carrier strip is not part of the ground connection. The various shorting bars 50 are simply snapped or broken from the carrier strip 58 at score lines 61.

As illustrated in FIG. 3, the first portion 52 is generally planar and is positioned in a plane vertically spaced from the plane of the second portion 54. In the embodiment illustrated in FIG. 3, the first portion 52 is located in a plane vertically above the second portion 54 (or portion 54 is vertically below portion 52). The shorting bar 50 maintains the signal conductor 16 and ground conductor 18 within separate planes to improve the signal integrity of the cable structure and reduce the possibility of the signal conductors 16 shorting to ground. Furthermore, the shorting bar eliminates a conductor cross-over and maintains the terminal ends of the conductors in a side-by-side fashion, as shown in FIGS. 1 and 2. The shorting bar 50 also maintains and keeps the housing contacts 26 for both the signal conductors 16 and the ground conductors 18 in a common plane. In that way, as illustrated in FIGS. 1 and 2, all the openings 46 are generally within a single plane providing for a suitably compact connector structure.

Referring again to FIGS. 1 and 2, the shorting bar is positioned within the connector housing 24, generally rearwardly of the rear end of the contact to which it is connected, e.g. contact 26*g*. The first portion 52 is generally planar and forms a pad structure which is electrically coupled to a housing contact and specifically to ground contact 26*g* proximate or in the contact plane defined by the contacts. The first portion 52 overlays the strip portion of the contact 26*g* and is welded to the contact 26*g,* and is thereby positioned generally within the plane 53 defined by the housing contacts 26 (see FIG. 3). Referring to FIG. 3, through the transition portion 56, the shorting bar 50 transitions sharply down to the second portion 54 which lies within a plane 55 vertically spaced from the plane 53 defined by the housing contacts 26.

In the embodiment illustrated in the Figures, plane 55, which is referred to as the grounding plane, will either be considered to be below or above the housing contact plane 53 depending upon which way the cable structure 10 and connector housing 24 are oriented as a point of reference. As illustrated in FIG. 2, the second portion 54 of the shorting bar 50 extends below the signal conductors 16 and contacts 26 to engage the ground conductors, or drain wires, 18. The signal conductors 16 may be bent upwardly from the longitudinal axis of the respective transmission lines 12*a*, 12*b* in order to engage the contacts 26. Alternatively, the connector housing 24 might be molded such that the individual signal conductors 16 simply extend straight from the transmission lines 12*a*, 12*b* and generally parallel to the longitudinal axis thereof. The signal conductors 16 are bent slightly to the sides of lines 12 so that they may engage the contacts as shown in the Figures.

The ground conductors are electrically coupled, such as by welding, to the legs 60 in a plane spaced from the contact plane. The ground conductor 18 of each transmission line may be bent slightly downwardly to engage second portion 54 of the shorting bar 53, as illustrated in FIG. 2. In accordance with one aspect of the present invention, the shorting bar is utilized to couple multiple ground conductors 18 to a single ground contact, such as contact 26*g*. To that end, the shorting bar second portion 54 includes a plurality of legs 60 (see FIG. 4) which extend laterally with respect to the longitudinal axis 62 of the bar. As illustrated in FIG. 4, the legs 60 extend generally laterally in the direction of arrows 61 from axis line 62. The elongated first portion 52 defines axis 62. In the embodiment illustrated in the Figures, the shorting bar 50 is positioned such that the first portion 52 is positioned between the conductors 16, 18 of the transmission lines 12. In that way, each leg 60 services a ground conductor 18 from each transmission line 12. The legs of the shorting bar also eliminate cross-over of the conductors to further prevent the possibility of shorting, particularly when the connector body is molded.

The shorting bar 50 also is configured to position the conductors 16, 18, not only in different planes, as discussed above, but also to position the terminal ends of one set of conductors forward of the terminal ends of the other set of conductors. In the embodiment disclosed in the Figures, the ends of the signal conductors 16 are positioned forward of the ends of the ground conductors 18. This positioning further ensures physical separation of the conductors to improve signal integrity and the reliability of the cable structure 10.

The ends of the signal conductors 16 are each welded to respective contacts 26 while the ends of the ground wires 18 are welded to the legs 60 of the shorting bar 50. The shorting bar first portion 52 is then, in turn, welded to a respective contact 26*g*. The embodiment of the invention illustrated in FIG. 4 is essentially symmetric with respect to the axis line 62. However, in alternative embodiments, the shorting bar might be somewhat asymmetric in which one of the legs 60 is longer than another. For example, the first portion 52 might be welded to one of the contacts 26 on either side of the center ground contact 26*g,* thus making the contact to which the shorting bar is welded the ground contact. The multiple legs 60 of the shorting bar 50 allow multiple ground conductors to be coupled to a single housing contact 26*g* without cross-over of the signal and ground conductors.

Referring to FIG. 1, the shield pad 39 is welded to contact 26*g* forward of the first portion 52. This grounds the shield by electrically coupling the shield to the shorting bar 50, the ground contact 26*g* and the ground conductors 18. The present invention provides a robust ground connection while maintaining a compact and relatively small connector. The invention maintains signal integrity by maintaining a desirable distance between a ground plane containing the ground conductors and a contact plane defined by the housing contacts to which the signal conductors are welded. Furthermore, the shorting bar of the invention maintains the exposed terminal ends of the ground conductors 18 rearwardly of the exposed terminal ends of the signal conductors 16 and eliminate cross-over to further reduce and prevent the signal conductors from shorting to ground. That is, in accordance with one aspect of the present invention, one of the first and second portions of the grounding bar is positioned rearwardly of the other portion in order to longitudinally space the signal conductors from the ground conductors. In the embodiments illustrated in the Figures, the second portion is positioned rearwardly of the first portion to position the ground conductors 18 rearwardly of the signal conductors 16.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A cable structure for signal transmission comprising:

a connector housing;

a plurality of housing contacts positioned within a defined contact plane in the connector housing, the housing contacts configured for engaging contacts of a device when the cable structure is coupled to [a] the device;

at least one signal conductor terminating in the connector housing, the signal conductor being electrically coupled to one of the housing contacts generally in said contact plane;

at least one ground conductor terminating in the connector housing;

an electrically conductive shorting bar having a first portion and a second portion, the second portion being positioned generally in a plane vertically spaced from the first portion, the first portion being electrically coupled to one of the [a] housing contacts proximate the contact plane;

the ground conductor being electrically coupled to the second portion in a plane spaced from the contact plane;

the shorting bar maintaining the signal conductor and ground conductor terminations within separate, vertically-spaced planes to improve the signal integrity of the cable structure while keeping the housing contacts in the common plane: and a shield, the shield including a tab electrically coupled to said shorting bar through a contact for electrically coupling the shield to the ground conductor.

2. The cable structure of claim 1 wherein the shorting bar includes a transition portion spanning between the first and second portions for electrically coupling the two portions, the transition portion being integrally formed with the first and second portions.

3. The cable structure of claim 1 wherein said ground conductor is welded to said shorting bar.

4. The cable structure of claim 1 wherein said shorting bar is welded to said housing contact.

5. The cable structure of claim 1 wherein said shorting bar has a unitary construction and is generally free of score lines between the first and second portions.

6. The cable structure of claim 1 wherein one of said first and second portions is positioned rearwardly of the other portion in order to longitudinally space the signal conductor from the ground conductor.

7. The cable structure of claim 1 further comprising multiple signal and ground conductors terminating in the connector housing, the shorting bar second portion including a plurality of legs, the legs each being electrically coupled to a ground conductor such that multiple ground conductors are electrically coupled to a single housing contact.

8. The cable structure of claim 7 wherein said shorting bar includes at least two legs for coupling two ground conductors to a housing contact.

9. The cable structure of claim 7 wherein said legs are configured to extend laterally with respect to said first portion, terminal ends of the ground conductors electrically coupled to the legs and laterally spaced from the housing contact to which the shorting bar is coupled.

10. A cable structure for signal transmission including a connector with terminal ends of ground and signal conductors electrically coupled to contacts located in a contact plane within a connector housing, the cable structure further comprising:

an electrically conductive shorting bar having a first portion and a second portion, the second portion being positioned generally in a plane vertically spaced from the first portion, the first portion being electrically coupled to one of the housing contacts proximate the contact plane;

the ground conductor being electrically coupled to the second portion in a plane spaced from the contact plane;

the shorting bar maintaining the signal conductor and ground conductor terminations within separate, vertically-spaced planes to improve the signal integrity of the cable structure while keeping the housing contacts in the common plane; and a shield, the shield including a tab electrically coupled to said shorting bar through a contact for electrically coupling the shield to the ground conductor.

11. The cable structure of claim 10 wherein the shorting bar includes a transition portion spanning between the first and second portions for electrically coupling the two portions, the transition portion being integrally formed with the first and second portions.

12. The cable structure of claim 10 wherein said shorting bar has a unitary construction and is generally free of score lines between the first and second portions.

13. The cable structure of claim 10 wherein the shorting bar second portion includes a plurality of legs configured for being coupled to a plurality of ground conductors such that multiple ground conductors are electrically coupled to a single housing contact.

14. The cable structure of claim 13 wherein said shorting bar includes at least two legs for coupling two ground conductors to a housing contact.

15. The cable structure of claim 13 wherein said legs are configured to extend laterally with respect to the first portion, so that the ground conductors electrically coupled to the legs are laterally spaced from the housing contact to which the shorting bar is coupled.

16. A method of constructing a cable structure for signal transmission comprising:

providing a connector housing;

arranging a plurality of housing contacts within a defined contact plane in the housing, the housing contacts configured for engaging contacts of a device when the cable structure is coupled to the device;

electrically coupling the terminal end of at least one signal conductor to one of the housing contacts generally in said contact plane;

positioning at least one ground conductor along the signal conductor to terminate proximate the terminal end of the signal conductor;

positioning an electrically conductive shorting bar proximate the housing contacts, the shorting bar including a first portion and including a second portion which is positioned generally in a plane vertically spaced from the first portion;

positioning the first portion of the shorting bar proximate said contact plane and electrically coupling the first portion to one of the housing contacts;

electrically coupling the ground conductor to the second portion in a plane spaced from the contact plane;

the shorting bar maintaining the signal conductor and ground conductor termination within separate spaced planes to improve the signal integrity of the cable structure while keeping the housing contacts in the common plane; and electrically coupling a shield to said grounding bar through a contact for electrically coupling the shield to the ground conductor.

17. The method of claim 16 wherein said shorting bar second portion includes a plurality of legs, the method further comprising electrically coupling multiple ground conductors to the legs such that multiple ground conductors are electrically coupled to a single housing contact.

18. The method of claim 17 wherein said legs are configured to extend laterally from said first portion, the method further comprising electrically coupling the ground conductors to the legs at a position laterally spaced from the housing contact to which the shorting bar is coupled.

* * * * *